United States Patent [19]

Schwartz

[11] 4,426,466

[45] Jan. 17, 1984

[54] PAPER TREATMENT COMPOSITIONS CONTAINING FLUOROCHEMICAL CARBOXYLIC ACID AND EPOXIDIC CATIONIC RESIN

[75] Inventor: Craig A. Schwartz, Oakdale, Minn.

[73] Assignee: Minnesota Mining and Manufacturing Company, St. Paul, Minn.

[21] Appl. No.: 386,631

[22] Filed: Jun. 9, 1982

[51] Int. Cl.[3] ..... C14C 9/00; D21H 3/02; D21H 3/58

[52] U.S. Cl. ..... 523/455; 162/164.2; 162/164.3; 428/537

[58] Field of Search ..... 523/455; 162/164.2, 162/164.3; 428/537

[56] References Cited

U.S. PATENT DOCUMENTS

| | | | |
|---|---|---|---|
| 2,809,990 | 10/1957 | Brown | 528/391 |
| 3,348,997 | 10/1967 | Lagally et al. | 162/164.3 |
| 3,382,097 | 5/1968 | Erby et al. | 117/141 |
| 3,409,647 | 11/1968 | Pittman et al. | 260/408 |
| 3,655,506 | 4/1972 | Baggett | 162/164 |
| 3,778,339 | 12/1973 | Williams et al. | 162/164.2 |
| 3,901,864 | 8/1975 | Jager | 526/246 |
| 3,947,383 | 3/1976 | Baggett | 528/405 |
| 4,020,087 | 4/1977 | Hiestand et al. | 548/318 |
| 4,097,642 | 6/1978 | Dear et al. | 428/262 |
| 4,239,915 | 12/1980 | Falk | 562/481 |
| 4,240,935 | 12/1980 | Dumas | 524/72 |
| 4,243,481 | 1/1981 | Dumas | 162/158 |
| 4,279,794 | 7/1981 | Dumas | 162/164.3 |
| 4,299,654 | 11/1981 | Tlach et al. | 162/164.3 |
| 4,302,366 | 11/1981 | Perronin et al. | 252/8.57 |

FOREIGN PATENT DOCUMENTS 1533434 11/1978 United Kingdom .

OTHER PUBLICATIONS

Putnam et al., "Papermaking Additives," Kirk-Othmer Encyclopedia of Chemical Technology, 3rd Ed., vol. 16, pp. 803-825 (1981).

Dumas, "An Overview of Cellulose Reactive Sizes," TAPPI conference preprint, Sizing Short Course, Chicago, Ill. (1981).

Bates, "Polyamide-Epichlorohydrin Wet-Strength Resin," *TAPPI, The Journal of the Technical Association of the Pulp and Paper Industry,* 52, 6, (Jun. 1969).

Davison, "The Sizing of Paper," *TAPPI, The Journal of the Technical Association of the Pulp and Paper Industry,* 58, 3, p. 45, (Mar. 1975).

Davis, et al., "A New Sizing Agent for Paper—Alkylketene Dimers," *TAPPI, The Journal of the Technical Association of the Pulp and Paper Industry,* 39, 1, pp. 21-23 (Jan. 1956).

Rengel and Young, "Internal Sizing of Paper and Paperboard," TAPPI monograph series number 33, pp. 170-189 (1971).

Colbert, "Fluorochemicals-Fluid Repellency for Non--Woven Substrates," *TAPPI, The Journal of the Technical Association of the Pulp and Paper Industry,* 59, 9, (Sep. 1976).

Banks, Ed., *Organofluorine Chemicals and their Industrical Applications,* pp. 231-234 (1979).

Schwartz, "Oil Resistance Utilizing Fluorochemicals," TAPPI conference preprint, 1980 Sizing Short course, Atlanta, Ga.

Guenthner, *Kirk-Othmer Encyclopedia of Chemical Technology,* 3rd Ed., vol. 10, p. 897 (1980).

*Primary Examiner*—Ronald W. Griffin

*Attorney, Agent, or Firm*—Donald M. Sell; James A. Smith; David R. Cleveland

[57] ABSTRACT

Cellulosic products are sized with treatment compositions prepared from (a) fluoroaliphatic radical-containing carboxylic acid or a salt or hydrolyzable precursor thereof, (b) water-soluble epoxidic cationic resin made by reacting epihalohydrin with ammonia or aminopolymer, and (c) an optional hydrophobic hydrocarbon sizing agent.

19 Claims, No Drawings

PAPER TREATMENT COMPOSITIONS CONTAINING FLUOROCHEMICAL CARBOXYLIC ACID AND EPOXIDIC CATIONIC RESIN

TECHNICAL FIELD

This invention relates to sizing treatment compositions which impart oil and water repellency to cellulosic materials (e.g., paper). In addition, this invention relates to cellulosic materials, and shaped articles made therefrom, which have been treated with such compositions. Also, this invention relates to a method for treating cellulosic materials with such compositions to impart oil and water repellency thereto.

BACKGROUND ART

Various fluorochemical wet pick-up and internal sizing agents for paper treatments are described, for example, in Rengel and Young, "Internal Sizing of Paper and Paperboard," TAPPI monograph series number 33, pps. 170–189 (1971), Colbert, "Fluorochemicals-Fluid Repellency for Non-Woven Substrates," *TAPPI, The Journal of the Technical Association of the Pulp and Paper Industry,* 59, 9, (September, 1976), Banks, Ed., *Organofluorine Chemicals and their Industrial Applications,* pps. 231–234 (1979), Schwartz, "Oil Resistance Utilizing Fluorochemicals," TAPPI conference preprint, 1980 Sizing Short Course, Atlanta, Ga., Putnam et al., "Papermaking Additives," *Kirk-Othmer Encyclopedia of Chemical Technology,* 3rd Ed., Vol. 16, pps. 812–813, (1981), and U.S. Pat. Nos. 2,809,990, 3,382,097, 3,409,647, 3,901,864, 4,239,915, and 4,302,366.

DISCLOSURE OF INVENTION

The present invention provides, in one aspect, sizing treatment compositions which impart oil and water repellency, at low usage levels, to cellulosic materials (such as paper), said compositions comprising:

(a) fluoroaliphatic radical-containing carboxylic acid or a salt or hydrolyzable precursor thereof, and (b) water-soluble epoxidic cationic resin comprising a reaction product of epihalohydrin with ammonia or aminopolymer.

The present invention also provides sizing treatment compositions comprising the above components (a) and (b), together with (c) hydrophobic hydrocarbon sizing agent.

In addition, the present invention provides cellulosic materials treated with the above-described sizing treatment compositions, and shaped articles made from such treated cellulosic materials.

Also, the present invention provides a method for treating cellulosic materials to impart oil and water repellency thereto, comprising the step of applying to said cellulosic materials the above-described sizing treatment compositions.

Through the use of the above-described sizing treatment compositions, cellulosic materials can be rendered oil and water repellent at lower sizing treatment composition levels than have been required with previously-utilized sizing treatment compositions.

DETAILED DESCRIPTION

In the practice of the present invention, said carboxylic acid, and the salts and hydrolyzable precursors thereof (viz., component (a) above) contain one or more fluoroaliphatic radicals $R_f$. Each $R_f$ radical can be the same as or different from other $R_f$ radicals in component (a). $R_f$ is a monovalent, fluorinated, aliphatic, preferably saturated, organic radical having at least three fully fluorinated carbon atoms. Preferably, $R_f$ contains not more than 20 carbon atoms, because such a large radical results in inefficient use of the fluorine content. The skeletal chain of $R_f$ can be straight, branched, or if sufficiently large, cyclic, and can include catenary divalent oxygen atoms or trivalent nitrogen atoms bonded only to carbon atoms. Preferably, $R_f$ is fully fluorinated, but carbon-bonded hydrogen or chlorine atoms can be present as substituents on the skeletal chain of $R_f$, provided that not more than one atom of either hydrogen or chlorine is present for every two carbon atoms in the skeletal chain of $R_f$, and further provided that $R_f$ contains at least a terminal perfluoromethyl group. Preferably, $R_f$ has a average of about 6 to 12 carbon atoms.

The fluoroaliphatic radical-containing carboxylic acids or salts contain one or more carboxyl-containing radicals of the formula —COOM where M is hydrogen, an alkali metal, or an ammonium or organoammonium ion. Each COOM radical can be the same as or different from other COOM radicals in component (a). Preferably, M is an ammonium ion.

The hydrolyzable precursors of the fluoroaliphatic radical-containing carboxylic acids include acid halides, acid anhydrides, acid esters, and other precursors which will generate fluoroaliphatic acids or salts upon contact with water. The acid halides contain one or more radicals of the formula —COX where X is a halogen atom (e.g., fluorine or chlorine). The acid anhydrides have the formula $(R_fQCO)_2O$ where $R_f$ is as defined above and Q is as defined below for formula I. The acid esters contain one or more radicals of the formula $—COOR^1$ where $R^1$ is a lower (e.g., $C_{1-4}$) alkyl radical.

For purposes of brevity, the fluoroaliphatic radical-containing carboxylic acids and the salts and hydrolyzable precursors thereof will sometimes be referred to hereafter collectively as "fluorocarboxylic acids." Preferred fluorocarboxylic acids for use in this invention have the formula:

$$(R_f)_pQ(COOM)_q \qquad \text{I}$$

wherein:

$R_f$ and M are as defined above;

Q is a carbon-carbon bond or a polyvalent, preferably divalent linking group, for example, a group selected from —O—, —S—, —N<, —CO—, $—NR^2—$, $—CONR^2—$, —CON<, $—SO_2NR^2—$, $—SO_2N<$, $—SO_2—$, $—C_nH_{2n}—$, —CH=CH—, $—OC_2H_4—$, $—C_6H_4—$, $—C_6H_3<$, $>C_6H_2<$, $—C_6H_3Cl—$, $—C_6Cl_4—$, heteroaromatic radicals, cycloaliphatic radicals, and the like or combinations thereof, where $R^2$ is hydrogen or a $C_{1-4}$ alkyl radical, and n is 1 to 20;

p is 1 to 3; and q is 1 to 4;

or is a hydrolyzable precursor of an acid or salt of said Formula I. Representative compounds of formula I include:

$C_7F_{15}COOH$,
$C_8H_{17}SO_2N(C_2H_5)CH_2COONH_4$,
$C_8H_{17}SO_2OC_6H_4COOH$,

-continued

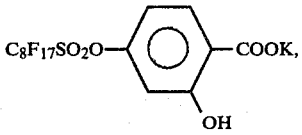

$C_8F_{17}SO_2N(CH_3)(CH_2)_{10}COONa$,
$C_6F_{13}C_2H_4SC_2H_4COOH$,
$C_6H_{13}C_2H_4SO_2C_2H_4COONH_4$,
$C_8F_{17}SO_2NHC_2H_4N(CH_2COOH)_2$,
$C_7F_{15}CONHCH_2COONH_2(C_2H_4OH)_2$,
$C_8H_{17}SO_2N(C_2H_5)CH_2C_6H_4COOH$,
$(CF_3)_2CFOC_2F_4CH_2COOLi$,
$(C_3F_7)_2C_6H_3SO_2N(CH_3)CH_2COOH$,

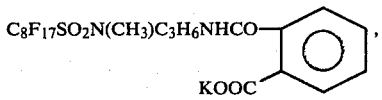

$C_8F_{17}C_2H_4COONH_4$,
$C_2F_5C_6F_{10}COOH$,
$C_2F_5C_6F_{10}CONHCH_2COONH_4$,
$C_8F_{17}C_2H_4SO_2N(CH_3)CH_2COOH$,
$(CF_3)_2CFOC_3H_6COOK$,
$(C_6F_{13}C_2H_4S)_2C(CH_3)C_2H_4COONa$, $$\begin{array}{l} C_8F_{17}C_2H_4SCHCOONH_4 \\ \quad\quad\quad\quad\quad\quad | \\ C_8F_{17}C_2H_4SCHCOONH_4, \end{array}$$

$C_8F_{17}SO_2OC_6H_4NHCOC_6Cl_4COOK$,
$C_8F_{13}C_2H_4SO_2N(CH_3)C_2H_4OOCC_2H_4SCH_2COONH_4$,
$C_8F_{17}SO_2N(CH_2COOH)C_2H_4N(CH_2COOH)_2$,

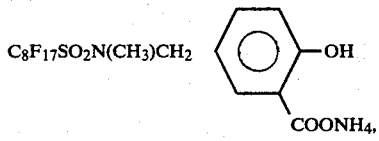

$C_8F_{17}SO_2NH(CH_2)_{10}COOH$,
$C_8F_{17}SO_2N(C_4H_8COONH_4)_2$, and
$C_8F_{17}SO_2N(C_2H_5)C_2H_4OOCCH{=}CHCOONa$.

Representative hydrolyzable precursors of compounds of Formula I include:

$C_6F_{15}COF$, $C_8F_{17}COOCH_3$, and $(C_8F_{17}CH_2CO)_2O$.

A preferred subclass of fluorocarboxylic acids for use in this invention has the formula:

$$R_fSO_2N(R^3)R^4COOM \qquad \text{II}$$

wherein:

$R_f$ and M are as defined above;

$R^3$ is hydrogen or a $C_{1-4}$ alkyl radical; and $R^4$ is a $C_{1-6}$ alkylene radical;

or is a hydrolyzable precursor of an acid or salt of said Formula II. In fluorocarboxylic acids of formula II, M is preferably an ammonium ion, $R^3$ is preferably methyl or ethyl, and $R^4$ is preferably methylene.

The above-described fluorocarboxylic acids can be prepared by known methods including electrochemical fluorination and telomerization to yield intermediates which are converted to the desired fluorocarboxylic acids by known reactions, e.g., hydrolysis, condensation reactions, or addition reactions. Suitable preparative methods for such fluorocarboxylic acids and intermediates are described, for example, in Guenthner, *Kirk-Othmer Encyclopedia of Chemical Technology,* 3rd Ed., Vol. 10, p. 897 (1980) and U.S. Pat. Nos. 2,809,990, 3,382,097, 3,409,647, 3,901,864, 4,020,087, 4,097,642, 4,239,915, and 4,302,366.

The water-soluble epoxidic cationic resins used in this invention (viz., component (b) above) are reaction products of epihalohydrin (e.g., epichlorohydrin) with ammonia or aminopolymers. Preferably, the epoxidic cationic resins are reaction products of epichlorohydrin with aminopolymers. Suitable aminopolymers include (a) addition polymers of N-alkyldiallylamines, (b) condensation polymers of polyalkylene polyamines (e.g., bis(N,N'-3-aminopropyl) piperazine) with cyanamide or dicyandiamide, and (c) condensation polymers of polyalkylene polyamines, cyanamide, or dicyandiamide with dicarboxylic acids (e.g., adipic acid) or esters of dicarboxylic acids. Preferably, the epoxidic cationic resin is the reaction product of epichlorohydrin with a condensation polymer of diethylenetriamine and dicyandiamide.

Said reaction products of epihalohydrin with ammonia or aminopolymers have cationic quaternary nitrogen sites and pendant epoxide groups. If desired, the epoxide groups of the reaction product can be converted to chlorohydrin groups by combining the reaction product with hydrochloric acid. The resulting chlorohydrin-functional reaction product has particularly good storage characteristics. The active epoxide-functional reaction product can be regenerated by the addition of a base (e.g., aqueous sodium hydroxide),or by adding the chlorohydrin-functional reaction product to an alkaline papermaking slurry. For purposes of brevity, said chlorohydrin-functional reaction products will be included hereafter within the definition of said reaction products of epihalohydrin with ammonia or aminopolymers.

Suitable water-soluble epoxidic cationic resins, and preparative methods therefor, are described, for example, in Bates, "Polyamide-Epichlorohydrin Wet-Strength Resin", TAPPI, *The Journal of the Technical Association of the Pulp and Paper Industry,* 52, 6, (June 1969), in U.S. Pat. Nos. 3,655,506, 3,947,383, 4,240,935, 4,243,481, 4,279,794, and 4,299,654, and in U.K. Patent Specification No. 1,533,434.

Use of the optional hydrophobic hydrocarbon sizing agents (viz., component (c) above) permits a reduction in the amount of components (a) and (b) employed and a reduction in the total cost of the sizing treatment composition. Preferred hydrophobic hydrocarbon sizing agents are cellulose-reactive materials and include (a) alkyl ketene dimers, (b) octadecyl isocyanates, (c) alkenyl succinic anhydrides, and (d) rosin acid anhydrides. Alkyl ketene dimers are most preferred for use in the sizing treatment compositions of this invention. Especially preferred alkyl ketone dimers have the formula:

$$\begin{array}{l} R^5{-}CH{=}C{-}{-}O \\ \quad\quad\quad\quad | \quad\quad | \\ R^5{-}CH{-}C{=}O \end{array} \qquad \text{III}$$

wherein $R^5$ is a hydrocarbon radical, such as an alkyl radical of at least 8 carbon atoms, a cycloalkyl radical of at least 6 carbon atoms, an aryl radical, an aralkyl radical, or an alkaryl radical. Each $R^5$ can be the same or different.

Suitable hydrophobic sizing agents are described in Putnam, op. cit., p. 811, Davison, "The Sizing of Paper," *TAPPI, The Journal of the Technical Association of the Pulp and Paper Industry*, 58, 3, p. 54, (March, 1975), Davis, et al., "A New Sizing Agent for Paper—Alkylketene Dimers," *TAPPI, The Journal of the Technical Association of the Pulp and Paper Industry*, 39, 1, pp. 21≦23 (January, 1956), Dumas, "An Overview of Cellulose Reactive Sizes," TAPPI conference preprint, Sizing Short Course, Chicago, Ill. (1981), U.S. Pat. Nos. 4,240,935, 4,243,481, and 4,279,794, and U.K. Patent Specification No. 1,533,434.

The sizing treatment compositions of this invention can be used in combination with compatible papermaking adjuvants such as natural and synthetic wax emulsions, starch, dextrin, alum, retaining agents, buffering agents, fireproofing agents, fungicidal agents, antistatic agents, dyes, optical bleaching agents, sequestering agents, mineral salts, swelling agents, and fillers such as clay, talc, and titanium dioxide. The sizing treatment compositions of this invention can be used in acidic or alkaline papermaking, with the latter being preferred. Fluorochemical sulfinates are preferably excluded from the sizing treatment compositions of this invention.

The sizing treatment compositions of this invention are applied to paper, paperboard, and other cellulosic materials in the form of solutions, emulsions, or dispersions in a suitable carrier (e.g., aqueous media or a mixture of water and organic solvents) in accordance with known methods. The compositions of the invention can be applied by spraying, padding, immersion, foaming, or by "wet end" (internal) addition. Wet end addition is preferred. For wet end addition, the pulp slurry will generally contain about $1.5\times10^{-4}$ to $7.5\times10^{-3}$ percent by weight of each component of the sizing treatment composition, with these amounts being adjusted to provide the desired application level of each component on the cellulosic material to be treated.

Components (a), (b), and optional component (c) can be applied sequentially or as a mixture to cellulosic materials. For wet end addition, component (b) and optional component (c) are preferaably added to the furnish first followed by mixing of the furnish and addition of component (a).

Components (a), (b), and optional component (c) are applied to cellulosic materials in amounts sufficient to provide the desired level of oil and water repellency. In general, these amounts are about 0.03 to 0.3 percent solids on fiber (SOF) of component (a), 0.1 to 1.5 percent SOF of component (b), and 0 to 1.5 percent SOF of optional component (c). Preferred amounts are about 0.08 to 0.14 percent SOF of component (a), about 0.4 to 0.8 percent SOF of component (b), and about 0.05 to 0.1 percent SOF of optional component (c).

Cellulosic materials which have been treated with the sizing treatment compositions of this invention can be formed, using conventional techniques, into paperboard, or into shaped articles such as bags, trays, plates, and the like. The sizing treatment compositions of this invention have particular utility in the manufacture of molded or die-stamped paper plates.

Cellulosic substrates treated with the sizing treatment compositions of this invention can be evaluated for oil and water repellency using the following tests:

Kit Test for Oil Repellency.

TAPPI Useful Method 557 is employed to determine the Kit rating value. Test samples are scored between 1 and 12. The higher the Kit rating for a test sample, the better is the oil repellency of the test sample.

Cobb Test for Water Repellency.

TAPPI-T441-os-77 is employed to determine the Cobb rating. The lower the Cobb rating for a test sample, the better is the water repellency of the test sample.

Water Drop Test.

A drop of distilled water is placed on the cellulosic substrate for 15 seconds. The substrate is rated Fail (−) if the water drop completely wets the area of drop contact. The substrate is rated Pass (+) if any water holdout or non-wetting is observed in the area of drop contact.

Corn Oil Test.

A cellulosic substrate, in the form of a square paper sheet about 10 cm×10 cm, is clamped firmly between two 6 mm thick sample holder plates, each having a 6.5 cm diameter central hole. The upper sample holder plate has a 6.5 cm diameter×3 cm high sleeve surrounding the central hole and welded to the upper surface of the plate. The sample holder and paper sheet is placed on a glass table and a mirror is placed under the table so that the bottom surface of the paper sample can be observed. Corn oil is heated to 177° C. or 120° C. and poured into the sleeve to a height within about 1 cm from the top of the sleeve. After 15 min., the paper sheet is rated on a scale of 1 to 10, with 1 representing complete penetration of the entire lower surface of the paper sheet and 10 indicating no wetting or penetration of any part of the lower surface of the paper sheet.

Spinach Test.

Canned spinach ("Libby's Whole Leaf Spinach," commercially available from Libby, McNeill and Libby, Inc.) is heated to 88° C. and used in place of heated corn oil in the above-described corn oil test.

Two Percent Lactic Acid Test.

A two percent aqueous lactic acid solution is heated to 88° C. and used in place of heated corn oil in the above-described corn oil test.

One Percent Salt Water Test.

A one percent aqueous sodium chloride solution is heated to 88° C. and used in place of heated corn oil in the above-described corn oil test.

The following examples are offered to aid understanding of the present invention and are not to be construed as limiting the scope thereof. Unless otherwise indicated, all ratios and percentages are amounts by weight.

EXAMPLE NO. 1 AND COMPARISON EXAMPLE NOS. 1-2

A 0.25 percent aqueous solution of 75% pure $R_fSO_2N(C_2H_5)CH_2COOK$ was applied to 15 cm×15 cm pieces of unsized waterleaf paper (65 g/m$^2$) by padding using a laboratory size press. The treated paper was dried on a 50 cm×43 cm sheet dryer ("Williams Standard Pulp Testing Apparatus," commercially available from Williams Apparatus Co.) at 100° C. for one minute. A 0.83 percent aqueous solution of epichlorohydrin/aminopolymer resin ("S-2399," available from Hercules, Inc.) was applied to the fluorochemical-treated paper using the same laboratory size press apparatus. The treated paper was dried at 150° C. for one minute. The dried sheet contained 0.3 percent SOF fluorocarboxylic acid and one percent SOF epichlorohydrin/aminopolymer resin. In comparison examples, treated sheets containing 0.3 percent SOF fluorocarboxylic acid alone (Comparison Example 1) and one percent SOF epichlorohydrin/aminopolymer resin (Comparison Example 2) were similarly prepared. The oil and water repellency of the treated samples is set forth below in TABLE 1:

TABLE 1

| | Example No. 1 | Comparison Example No. 1 | Comparison Example No. 2 |
|---|---|---|---|
| Kit rating | 6 | 7 | NOR |
| Cobb rating | 21 | NWR | NWR |

NOR = No oil repellency
NWR = No water repellency

This example shows that compositions of this invention offered good oil and water repellency on cellulosic substrates, whereas compositions prepared without fluorocarboxylic acid had no oil or water repellency, and compositions prepared without epichlorohydrin-/aminopolymer resin had no water repellency.

EXAMPLE NO. 2

A two percent aqueous suspension of bleached sulfate wood pulp (50% hardwood/50% softwood) was subjected to beater refinement for about one hour to subdivide, break up and fibrillate the wood fibers, and then diluted with water to provide a suspension containing about 0.8 percent fibers. A quantity of epichlorohydrin-/aminopolymer resin ("Kymene 557 H," commercially available from Hercules, Inc.) sufficient to provide one percent SOF was added to the suspension, and the resulting mixture was stirred for about one minute using an air mixer. A quantity of $C_8F_{17}SO_2N(C_2H_5)CH_2COONH_4$ sufficient to provide 0.5 percent SOF was added to the suspension followed by additional mixing for about one minute. A quantity of the resulting furnish containing 10 g of treated fibers was poured into a 30.5 cm×30.5 cm sheet mold, mixed, and drained to form a 30.5 cm×30.5 cm paper handsheet. Excess water was removed by placing the handsheet between paper blotters under pressure. The treated paper handsheet was dried at 177° C. for two minutes. The treated handsheet was then evaluated and found to have the following performance:

| | |
|---|---|
| Kit rating | 7 |
| Corn oil test (177° C.) | 10 |
| 1% Salt water test (88° C.) | 10 |

These values represent excellent performance.

EXAMPLE NOS. 3-7 AND COMPARATIVE EXAMPLE NOS. 3-7

Treated handsheets weighing 10 g were prepared and evaluated using the method of Example 2, but with drying at 163° C. for two minutes. Set out below in Table II are the %SOF for each component of the sizing treatment compositions (based on the amount of each component as added to the furnish) and the test results obtained when the treated handsheets were evaluated for Kit rating, 177° C. corn oil repellency, and 88° C. two percent lactic acid repellency.

TABLE II

| | Example No. | | | | | Comparative Example No. | | | | |
|---|---|---|---|---|---|---|---|---|---|---|
| | 3 | 4 | 5 | 6 | 7 | 3 | 4 | 5 | 6 | 7 |
| Component (a), % SOF: | | | | | | | | | | |
| $C_8F_{17}SO_2N(C_2H_5)CH_2COONH_4$ | 0.12 | 0.12 | 0.12 | 0.12 | 0.12 | | | | | |
| $[C_8F_{17}SO_2N(C_2H_5)C_2H_4O]_2PO(ONH_4)$ | | | | | | 0.12 | 0.12 | 0.12 | 0.12 | 0.12 |
| Component (b), % SOF: | 0.1 | 0.2 | 0.3 | 0.4 | 0.5 | 0.1 | 0.2 | 0.3 | 0.4 | 0.5 |
| "S-2399" resin | | | | | | | | | | |
| Component (c), % SOF: | 0.3 | 0.3 | 0.3 | 0.3 | 0.3 | 0.3 | 0.3 | 0.3 | 0.3 | 0.3 |
| "Hercon 40" resin[1] | | | | | | | | | | |
| Test results: | | | | | | | | | | |
| Kit rating | 2+ | 3+ | 3+ | 4 | 4 | 3+ | 3+ | 2+ | 2+ | 1+ |
| Corn oil (177° C.) | 1 | 7 | 9 | 9 | 10 | 2 | 1 | 1 | 1 | 1 |
| 2% Lactic Acid (88° C.) | 9 | 10 | 10 | 10 | 10 | 10 | 10 | 8 | 9 | 8 |

[1]Alkyl ketene sizing agent believed to contain about 67% epichlorohydrin/aminopolymer resin (commercially available from Hercules, Inc.)

This example shows that the use of a fluorocarboxylic acid was much more effective than a fluorochemical phosphate when each was combined with an epichlorohydrin/aminopolymer resin and a ketene dimer resin.

EXAMPLE NOS. 8-15

Treated handsheets weighing 10 g (Examples 8-11) or 30 g (Examples 12-15) were prepared and evaluated using the method of Example 2, but with drying at 163° C. for two minutes (Examples 8-11) or 163° C. for five minutes (Examples 12-15). Set out below in Table III are the %SOF for component (a) (based on the amount added to the furnish and based on the amount found on the treated paper using fluorine analysis), the %SOF for components (b) and (c) (based on the amount added to the furnish), and the test results obtained when the treated handsheets were evaluated for 177° C. corn oil repellency and 88° C. two percent lactic acid repellency.

TABLE III

| | Example No. | | | | | | | |
|---|---|---|---|---|---|---|---|---|
| | 8 | 9 | 10 | 11 | 12 | 13 | 14 | 15 |
| Component (a), % SOF: | | | | | | | | |
| $C_8F_{17}SO_2N(C_2H_5)CH_2COONH_4$ in furnish | 0.137 | 0.118 | 0.098 | 0.080 | 0.116 | 0.102 | 0.077 | 0.058 |
| on paper (by F analysis) | 0.054 | 0.055 | 0.039 | 0.034 | 0.057 | 0.057 | 0.040 | 0.036 |
| Component (b), % SOF: | 0.5 | 0.5 | 0.5 | 0.5 | 0.5 | 0.5 | 0.5 | 0.5 |
| "M-2542" resin[1] | | | | | | | | |
| Component (c), % SOF: | 0.2 | 0.2 | 0.2 | 0.2 | 0.2 | 0.2 | 0.2 | 0.2 |

TABLE III-continued

| | Example No. | | | | | | | |
|---|---|---|---|---|---|---|---|---|
| | 8 | 9 | 10 | 11 | 12 | 13 | 14 | 15 |
| "Hercon 40" resin | | | | | | | | |
| Test results: | | | | | | | | |
| Corn oil (177° C.) | 10 | 10 | 2 | 1 | 10 | 10 | 8 | 1 |
| 2% Lactic acid (88° C.) | 10 | 10 | 10 | 10 | 10 | 10 | 10 | 10 |

[1]Epichlorohydrin/aminopolymer resin (available from Hercules, Inc.)

These examples show that sizing treatment compositions containing relatively small amounts of fluorocarboxylic acid could provide satisfactory oil and water repellency.

EXAMPLE NOS. 16–35

Treated handsheets weighing 30 g were prepared and evaluated using the method of Example 2, but with drying at 163° C. for about five minutes. The sizing treatment compositions contained one each of three different fluorocarboxylic acids (in salt form), with one of the fluorocarboxylic acids being employed in two different salt forms and at three different levels of purity [with purity being based on the amount of fluorochemical sulfinate, $RfSO_2^-$, present in component (a)]. Set out below in Table IV are the %SOF for each component in the sizing treatment compositions (based on the amount of each component as added to the furnish) and the test results obtained when the treated handsheets were evaluated for Kit rating, 177° C. corn oil repellency, and 88° C. spinach repellency.

TABLE IV

| | Example No. | | | | | | | | | |
|---|---|---|---|---|---|---|---|---|---|---|
| | 16 | 17 | 18 | 19 | 20 | 21 | 22 | 23 | 24 | 25 |
| Component (a), % SOF: | | | | | | | | | | |
| $C_8F_{17}SO_2N(C_2H_5)CH_2COONH_4$[1] | 0.12 | | | | | 0.10 | | | | |
| $C_8F_{17}SO_2N(C_2H_5)CH_2COOK$[2] | | 0.12 | | | | | 0.10 | | | |
| $C_8F_{17}SO_2N(C_2H_5)CH_2COOK$[3] | | | 0.12 | | | | | 0.10 | | |
| $C_8F_{17}SO_2N(C_2H_5)C_2H_4OOCCH{=}CHCOONH_4$ | | | | 0.12 | | | | | 0.10 | |
| $C_8F_{17}C_2H_4SC_2H_4COONH_4$ | | | | | 0.12 | | | | | 0.10 |
| Component (b), % SOF: | 0.5 | 0.5 | 0.5 | 0.5 | 0.5 | 0.5 | 0.5 | 0.5 | 0.5 | 0.5 |
| "M-2542" resin | | | | | | | | | | |
| Component (c), % SOF: | 0.2 | 0.2 | 0.2 | 0.2 | 0.2 | 0.2 | 0.2 | 0.2 | 0.2 | 0.2 |
| "Hercon 40" resin | | | | | | | | | | |
| Test results: | | | | | | | | | | |
| Kit rating | 5 | 4 | 4 | 5 | 4 | 4+ | 3+ | 3+ | 4+ | 4 |
| Corn Oil (120° C.) | 10 | 10 | 10 | 10 | 10 | 10 | 9 | 8 | 10 | 8 |
| Spinach (88° C.) | 10 | 10 | 10 | 10 | 10 | 10 | 10 | 10 | 8 | 10 |

| | Example No. | | | | | | | | | |
|---|---|---|---|---|---|---|---|---|---|---|
| | 26 | 27 | 28 | 29 | 30 | 31 | 32 | 33 | 34 | 35 |
| Component (a), % SOF: | | | | | | | | | | |
| $C_8F_{17}SO_2N(C_2H_5)CH_2COONH_4$[1] | 0.08 | | | | | 0.06 | | | | |
| $C_8F_{17}SO_2N(C_2H_5)CH_2COOK$[2] | | 0.08 | | | | | 0.06 | | | |
| $C_8F_{17}SO_2N(C_2H_5)CH_2COOK$[3] | | | 0.08 | | | | | 0.06 | | |
| $C_8F_{17}SO_2N(C_2H_5)C_2H_4OOCCH{=}CHCOONH_4$ | | | | 0.08 | | | | | 0.06 | |
| $C_8F_{17}C_2H_4SC_2H_4COONH_4$ | | | | | 0.08 | | | | | 0.06 |
| Component (b), % SOF: | 0.5 | 0.5 | 0.5 | 0.5 | 0.5 | 0.5 | 0.5 | 0.5 | 0.5 | 0.5 |
| "M-2542" resin | | | | | | | | | | |
| Component (c), % SOF: | 0.2 | 0.2 | 0.2 | 0.2 | 0.2 | 0.2 | 0.2 | 0.2 | 0.2 | 0.2 |
| "Hercon 40" resin | | | | | | | | | | |
| Test results: | | | | | | | | | | |
| Kit rating | 3+ | 2+ | 3 | 4 | 3 | 2+ | 1+ | 1+ | 3+ | 2+ |
| Corn oil (120° C.) | 9 | 1 | 1 | 10 | 1 | 1 | 1 | 1 | 6 | 1 |
| Spinach (88° C.) | 10 | 10 | 10 | 10 | 10 | 10 | 10 | 10 | 10 | 10 |

[1]Purified to remove $R_fSO_2^-$
[2]Contained about 9 mole % $R_fSO_2^-$
[3]Contained about 4 mole % $R_fSO_2^-$ These examples show that sizing treatment compositions containing relatively small amounts of fluorocarboxylic acid provided satisfactory oil and water repellency. The presence of fluorochemical sulfinates hampered oil repellency, particularly at low %SOF fluorocarboxylic acid levels.

EXAMPLE NOS. 36–42 AND COMPARATIVE EXAMPLE NOS. 8–9

A series of five epichlorohydrin/aminopolymer resins ("A," "B," "C," "D," and "E") were prepared following the general procedure of Example 1 of U.K. Patent Specification No. 1,533,434, by reacting dicyandiamide ("DCDA") and diethylenetriamine ("DETA") in a first reaction ("$C_1$") to form an aminopolymer, and reacting this aminopolymer with epichlorohydrin ("ECH") in a second reaction ("$C_2$") to form the epichlorohydrin/aminopolymer resin. In addition, a comparison aminopolymer resin ("F"), made by carrying out reaction $C_1$ but not reaction $C_2$, was also prepared. Set out below in Table V are the weight percent of each reactant and the reaction conditions employed to prepare resins "A"–"F":

TABLE V

| | Epichlorohydrin/aminopolymer resin | | | | | Amino-poly-mer resin |
|---|---|---|---|---|---|---|
| | A | B | C | D | E | F |
| Reactants, % | | | | | | |
| DCDA | 27.4 | 27.4 | 26.5 | 19 | 19 | 45 |
| DETA | 33.5 | 33.5 | 32.5 | 23 | 23 | 55 |
| ECH | 39.1 | 39.1 | 41 | 58 | 58 | — |
| Reaction conditions | | | | | | |
| $C_1$ temp, °C. | 125 | 125 | 160 | 160 | 160 | 160 |
| $C_1$ time, min. | 75 | 75 | 75 | 75 | 75 | 75 |
| $C_2$ temp, °C. | 60 | 60 | 60 | 60 | 60 | — |
| $C_2$ time, min. | 45 | 45 | 45 | 45 | 120 | — |
| Viscosity of $C_1$ product | Mod.[1] | Mod.[1] | High | High | High | High |
| pH of $C_2$ product[2] | 5 | 4.9 | 5 | 5 | 5 | — |

[1]Mod. = Moderate.
[2]Adjusted to the pH level shown using formic acid after diluting the $C_2$ reaction product with water to 20% solids.

$$\text{DCDA} + \text{DETA} \xrightarrow[C_1]{} \text{aminopolymer resin} \xrightarrow[C_2]{\text{ECH}} \text{epichlorohydrin/aminopolymer resin}$$

Solutions of the above epichlorohydrin/aminopolymer resins A–E and "Kymene 557H" and "M-2542" commercial epichlorohydrin/aminopolymer resins were each applied by padding to unsized waterleaf sheets to provide one percent SOF. The treated sheets were dried at 163° C. for about one minute and then treated by padding with a solution of fluorocarboxylic acid to provide 0.3% SOF. The treated sheets were again dried at 163° C. for about one minute, and evaluated as in Example 1. For these treated samples, the sizing treatment composition components were applied in "FCL" order, i.e., by applying the fluorocarboxylic acid last. Each treatment was then repeated in "FCF" order on a new unsized waterleaf sheet, i.e., by application of the fluorocarboxylic acid first.

In a comparison run, treated waterleaf sheets were prepared as above but aminopolymer resin F and "Betz 1275" polymeric cationic aliphatic amide were each used in place of the above epichlorohydrin-/aminopolymer resins.

Set out below in Table VI are the %SOF for each component in the sizing treatment compositions (based on the wet pick-up of each component) and the test results obtained for each order of addition of the sizing treatment composition components ("FCL" or "FCF") when the treated handsheets were evaluated for Kit rating, Cobb rating, and water drop repellency.

TABLE VI

| | Example No. | | | | | | | Comparative Example No. | |
|---|---|---|---|---|---|---|---|---|---|
| | 36 | 37 | 38 | 39 | 40 | 41 | 42 | 8 | 9 |
| Component (a), % SOF: | | | | | | | | | |
| $C_8F_{17}SO_2N(C_2H_5)CH_2COONH_4$ | 0.3 | 0.3 | 0.3 | 0.3 | 0.3 | 0.3 | 0.3 | 0.3 | 0.3 |
| Component (b), % SOF: | | | | | | | | | |
| A | 1 | | | | | | | | |
| B | | 1 | | | | | | | |
| C | | | 1 | | | | | | |
| D | | | | 1 | | | | | |
| E | | | | | 1 | | | | |
| "Kymene 557H" resin | | | | | | 1 | | | |
| "M-12542" resin | | | | | | | 1 | | |
| Comparison resin, % SOF: | | | | | | | | | |
| F | | | | | | | | 1 | |
| "Betz 1275" resin[1] | | | | | | | | | 1 |
| Test results, "FCL"[2] addition: | | | | | | | | | |
| Kit rating | 6 | 6 | 7 | 7 | 6+ | 7 | 6+ | 7 | 7 |
| Cobb rating | 26 | 28 | NWR | NWR | NWR | NWR | 26 | NWR | NWR |
| Water drop test | + | + | − | − | − | − | + | − | − |
| Test results, "FCF"[3] addition: | | | | | | | | | |
| Kit rating | 7 | 7 | 6+ | 7 | 7 | 7 | 6+ | 7 | 6+ |
| Cobb rating | 21 | 23 | 42 | 46 | 32 | 35 | 23 | NWR | NWR |
| Water drop test | + | + | + | + | + | + | + | − | − |

NWR = no water repellency
[1]Polymeric cationic aliphatic amide, commercially available from Betz Laboratories, Inc.
[2]FCL = fluorocarboxylic acid applied last
[3]FCF = fluorocarboxylic acid applied first These examples and comparative examples show that sizing treatment compositions containing epichlorohydrin/aminopolymer resins provided better water repellency than corresponding compositions containing other resins. Also, sizing treatment compositions containing medium viscosity epichlorohydrin-/aminopolymer resins generally provided better water repellency than corresponding compositions containing high viscosity epichlorohydrin/aminopolymer resins, particularly when the components of the composition were applied in "FCL" order.

EXAMPLE NOS. 43–44 AND COMPARATIVE EXAMPLE NO. 10

A sample of epichlorohydrin/aminopolymer resin "A" from Table V was reacted with hydrochloric acid (following the procedure described in columns 5 and 6 of U.S. Pat. No. 4,279,794) to convert the pendant 2,3-epoxypropyl groups of resin "A" to 2-hydroxy-3-chloropropyl groups. The resulting product was identified as resin "G". Separately, a sample of resin "A" was reacted with aqueous sodium bicarbonate solution to convert the pendant 2,3-epoxypropyl groups of resin "A" to 2,3-dihydroxypropyl groups, and the resulting product was identified as resin "H."

Unsized waterleaf sheets were treated by padding with a solution of fluorocarboxylic acid to provide 0.3% SOF, dried at 163° C. for one minute, treated by padding with resin "A," "G," or "H" to provide one percent SOF, and dried again at 163° C. for one minute. Set out below in Table VII are the % SOF for each component in the sizing treatment compositions (based on the wet pick-up of each component) and the numerical test results obtained when the treated handsheets were evaluated for Kit rating, Cobb rating, and water drop repellency.

TABLE VII

| | Example No. | | Comparative Example No. |
|---|---|---|---|
| | 43 | 44 | 10 |
| Component (a), % SOF: | | | |
| $C_8F_{17}SO_2N(C_2H_5)CH_2COONH_4$ | 0.3 | 0.3 | 0.3 |
| Component (b), % SOF: | | | |
| "A" resin | 1 | | |
| "G" resin | | 1 | |
| Comparison resin, % SOF: | | | |
| "H" resin | | | 1 |
| Test results: | | | |
| Kit rating | 8 | 7+ | 7 |
| Cobb rating | 30 | 26 | NWR |
| Water drop rating | + | + | − |

NWR = no water repellency

These examples and the comparative example show that sizing treatment compositions containing epichlorohydrin/aminopolymer resins with 2,3-epoxypropyl groups or 2-hydroxy-3-chloropropyl groups provided better water repellency than corresponding compositions containing resins with 2,3-dihydroxy groups.

EXAMPLE NOS. 45-66 AND COMPARATIVE EXAMPLE NOS. 11-32

Using the method of Example Nos. 36-42, but with only "FCF" application and drying at 135° C. for one minute, unsized waterleaf sheets were treated with sizing treatment compositions containing a variety of fluorocarboxylic acids and epichlorohydrin/aminopolymer resins. In the Comparative Examples the epichlorohydrin/aminopolymer resins were eliminated or an aminopolymer resin (resin "F" from Table V) was substituted for the epichlorohydrin/aminopolymer resin. Set out below in Tables VIII, IX, X, and XI are the % SOF for each component in the sizing treatment compositions (based on the wet pick-up of each component) and the test results obtained when the treated handsheets were evaluated for Kit rating, Cobb rating, and water drop repellency. For several of the Comparative Examples in Tables X and XI, the test results also include a water drop test which was run on the same sample 48 hours after the running of the first water drop test.

TABLE VIII

| | Example No. | | | | | | | | | | | |
|---|---|---|---|---|---|---|---|---|---|---|---|---|
| | 45 | 46 | 47 | 48 | 49 | 50 | 51 | 52 | 53 | 54 | 55 | 56 |
| Component (a), % SOF: | | | | | | | | | | | | |
| $C_8F_{17}SO_2N(C_2H_5)CH_2COONH_4$ | 0.3 | 0.3 | | | | | | | | | | |
| $C_8F_{17}SO_2NHCH_2COONH_4$ | | | 0.3 | 0.3 | | | | | | | | |
| $C_7F_{15}COONH_4$ | | | | | 0.3 | 0.3 | | | | | | |
| $C_8F_{17}SO_2N(CH_2COONH_4)C_2H_4N(CH_2COONH_4)_2$ | | | | | | | 0.3 | 0.3 | | | | |
| $C_8F_{17}SO_2OC_6H_4COONH_4$ | | | | | | | | | 0.3 | 0.3 | | |
| 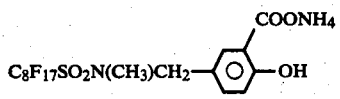 | | | | | | | | | | | 0.3 | 0.3 |
| Component (b), % SOF: | | | | | | | | | | | | |
| A | 1 | | 1 | | 1 | | 1 | | 1 | | 1 | |
| "M-2542" resin | | 1 | | 1 | | 1 | | 1 | | 1 | | 1 |
| Test results: | | | | | | | | | | | | |
| Kit rating | 7+ | 7 | 7 | 7 | 5 | 5 | 6 | 9 | 8 | 7 | 7+ | 9 |
| Cobb rating | 19 | 26 | 28 | 26 | 26 | 26 | 18 | 16 | 26 | 26 | 23 | 23 |
| Water drop test | + | + | + | + | + | + | + | + | + | + | + | + |

TABLE IX

| | Example No. | | | | | | | | | |
|---|---|---|---|---|---|---|---|---|---|---|
| | 57 | 58 | 59 | 60 | 51 | 62 | 63 | 64 | 65 | 66 |
| Component (a), % SOF: | | | | | | | | | | |
| $C_8F_{17}SO_2NH(CH_2)_{10}COONH_4$ | 0.3 | 0.3 | | | | | | | | |
| $C_8F_{17}SO_2N(C_4H_8COONH_4)_2$ | | | 0.3 | 0.3 | | | | | | |
| $C_8F_{17}C_2H_4SC_2H_4COONH_4$ | | | | | 0.3 | 0.3 | | | | |
| $C_8F_{17}C_2H_4SCHCOONH_4$ / $C_8F_{17}C_2H_4SCHCOONH_4$ | | | | | | | 0.3 | 0.3 | | |
| $C_8F_{17}SO_2N(C_2H_5)C_2H_4OOCCH{=}CHCOONH_4$ | | | | | | | | | 0.3 | 0.3 |
| Component (b), % SOF: | | | | | | | | | | |
| A | 1 | | 1 | | 1 | | 1 | | 1 | |
| "M-2542" resin | | 1 | | 1 | | 1 | | 1 | | 1 |
| Test results: | | | | | | | | | | |
| Kit rating | 4 | 4 | 6 | 7 | 6+ | 6+ | 6+ | 9+ | 4 | 5+ |
| Cobb rating | 26 | 26 | 28 | 26 | 26 | 23 | 26 | 26 | 23 | 26 |
| Water drop test | + | + | + | + | + | + | + | + | + | + |

TABLE X

| | Comparative Example No. | | | | | | | | | | | |
|---|---|---|---|---|---|---|---|---|---|---|---|---|
| | 11 | 12 | 13 | 14 | 15 | 16 | 17 | 18 | 19 | 20 | 21 | 22 |
| Component (a), % SOF: | | | | | | | | | | | | |
| $C_8F_{17}SO_2N(C_2H_5)CH_2COONH_4$ | 0.3 | 0.3 | | | | | | | | | | |
| $C_8F_{17}SO_2NHCH_2COONH_4$ | | | 0.3 | 0.3 | | | | | | | | |
| $C_7F_{15}COONH_4$ | | | | | 0.3 | 0.3 | | | | | | |
| $C_8F_{17}SO_2N(CH_2COONH_4)C_2H_4N(CH_2COONH_4)_2$ | | | | | | | 0.3 | 0.3 | | | | |
| $C_8F_{17}SO_2OC_6H_4COONH_4$ | | | | | | | | | 0.3 | 0.3 | | |
| 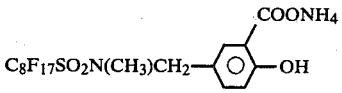 | | | | | | | | | | | 0.3 | 0.3 |
| Other resin, % SOF: F | 1 | | 1 | | 1 | | 1 | | 1 | | 1 | |
| Test results: | | | | | | | | | | | | |
| Kit rating | 6+ | 7 | 7 | 7 | 3+ | 3 | 5 | 9+ | 8 | 7 | 7 | 7 |
| Cobb rating | NWR | NWR | NWR | NWR | NWR | NWR | NWR | NWR | NWR | NWR | 21 | 42 |
| Water drop test | − | − | − | − | − | − | − | + | − | + | + | + |
| 48 hr Water drop test | | − | | − | | − | | − | | − | | + |

NWR = no water repellency

TABLE XI

| | Comparative Example No. | | | | | | | | | |
|---|---|---|---|---|---|---|---|---|---|---|
| | 23 | 24 | 25 | 26 | 27 | 28 | 29 | 30 | 31 | 32 |
| Component (a), % SOF: | | | | | | | | | | |
| $C_8F_{17}SO_2NH(CH_2)_{10}COONH_4$ | 0.3 | 0.3 | | | | | | | | |
| $C_8F_{17}SO_2N(C_4H_8COONH_4)_2$ | | | 0.3 | 0.3 | | | | | | |
| $C_8F_{17}C_2H_4SC_2H_4COONH_4$ | | | | | 0.3 | 0.3 | | | | |
| $C_8F_{17}C_2H_4SCHCOONH_4$ | | | | | | | 0.3 | 0.3 | | |
| $C_8F_{17}C_2H_4SCHCOONH_4$ | | | | | | | | | | |
| $C_8F_{17}SO_2N(C_2H_5)C_2H_4OOCH{=}CHCOONH_4$ | | | | | | | | | 0.3 | 0.3 |
| Other resin, % SOF: F | 1 | | 1 | | 1 | | 1 | | 1 | |
| Test results: | | | | | | | | | | |
| Kit rating | 3+ | 3 | 5 | 6 | 7+ | 7 | 8 | 9+ | 4 | 5 |
| Cobb rating | NWR | NWR | NWR | NWR | NWR | NWR | NWR | NWR | NWR | NWR |
| Water drop test | − | − | − | − | − | − | − | + | − | − |
| 48 hr Water drop test | | − | | − | | − | | − | | − |

NWR = no water repellency

These examples show that sizing treatment compositions containing epichlorohydrin/aminopolymer resins generally provided better water repellency (especially after 48 hours) than corresponding sizing treatment compositions which contained only fluorocarboxylic acid or fluorocarboxylic acid plus aminopolymer resin.

Various modifications and alterations of this invention will become apparent to those skilled in the art without departing from the scope and spirit of this invention, and it should be understood that this invention is not limited to the illustrative embodiments set forth herein.

What is claimed is:

1. Sizing treatment compositions, comprising:

(a) fluoroaliphatic radical-containing carboxylic acid or a salt or hydrolyzable precursor thereof, and (b) water-soluble epoxidic cationic resin comprising a reaction product of epihalohydrin with ammonia or aminopolymer.

2. Sizing treatment compositions according to claim 1, wherein said fluoroaliphatic radical-containing carboxylic acid or salt has the formula:

$$(R_f)_pQ(COOM)_q$$

wherein:

$R_f$ is a monovalent, fluorinated, aliphatic organic radical having at least 3 fully fluorinated carbon atoms;

M is hydrogen, an alkali metal, or an ammonium or organoammonium ion;

Q is a carbon-carbon bond or a polyvalent linking group;

p is 1 to 3; and q is 1 to 4;

or is a hydrolyzable precursor of an acid or salt of said formula.

3. Sizing treatment compositions according to claim 2, wherein Q is selected from —O—, —S—, —N<, —CO—, —$NR^1$—, —$CONR^1$—, —CON<, —$SO_2N$-$R^1$—, —$SO_2N$<, —$SO_2$—, —$C_nH_{2n}$—, —CH=CH—, —$OC_2H_4$—, —$C_6H_4$—, —$C_6H_3$<, >$C_6H_2$<, —$C_6H_3$-Cl—, —$C_6Cl_4$—, heteroaromatic radicals, cycloaliphatic radicals, or combinations thereof, where $R^1$ is hydrogen or a $C_{1-4}$ alkyl radical, and n is 1 to 20.

4. Sizing treatment compositions according to claim 1, wherein said fluoroaliphatic radical-containing carboxylic acid or salt has the formula:

$$R_fSO_2N(R^1)R^2COOM$$

wherein:

$R_f$ is a monovalent, fluorinated, aliphatic organic radical having at least 3 fully fluorinated carbon atoms;

M is hydrogen, an alkali metal, or an ammonium or organoammonium ion;

$R^1$ is hydrogen or a $C_{1-4}$ alkyl radical; and $R^2$ is a $C_{1-6}$ alkylene radical, or is a hydrolyzable precursor of an acid or salt of said formula.

5. Sizing treatment compositions according to claim 4, wherein M is an ammonium ion, $R^1$ is methyl or ethyl, and $R^2$ is methylene.

6. Sizing treatment compositions according to claim 1, wherein said fluoroaliphatic radical-containing carboxylic acid comprises $C_8F_{17}SO_2N(C_2H_5)CH_2COOH$ or a salt or hydrolyzable precursor thereof.

7. Sizing treatment compositions according to claim 1, wherein said water-soluble epoxidic cationic resin comprises the reaction product of epichlorohydrin with aminopolymer, said aminopolymer being selected from (a) addition polymers of N-alkyldiallylamines, (b) condensation polymers of polyalkylene polyamines with cyanamide or dicyandiamide, and (c) condensation polymers of polyalkylene polyamines, cyanamide, or dicyandiamide with dicarboxylic acids or esters of dicarboxylic acids.

8. Sizing treatment compositions according to claim 7, wherein said aminopolymer is a condensation polymer of diethylene triamine and dicyandiamide.

9. Sizing treatment compositions according to claim 7, wherein the epoxide groups of said reaction product are converted to chlorohydrin groups.

10. Sizing treatment compositions according to claim 1, further comprising hydrophobic hydrocarbon sizing agent in an amount sufficient to provide, on cellulosic material treated with said composition by wet end addition, about 0.05 to 0.1% solids on fiber of said hydrophobic hydrocarbon sizing agent.

11. Sizing treatment compositions according to claim 10, wherein said hydrophobic hydrocarbon sizing agent is selected from alkyl ketene dimer, octadecyl isocyanate, alkenyl succinic anhydride, or rosin acid anhydride.

12. Sizing treatment compositions according to claim 11, wherein said hydrophobic hydrocarbon sizing agent comprises alkyl ketene dimer of the formula:

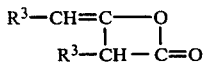

wherein $R^3$ is a hydrocarbon radical, a cycloalkyl radical, an aryl radical, an aralkyl radical, or an alkaryl radical.

13. Sizing treatment compositions, comprising $C_8F_{17}SO_2N(C_2H_5)CH_2COOH$ or a salt or hydrolyzable precursor thereof, water-soluble epoxidic cationic resin comprising the reaction product of epichlorohydrin with a condensation polymer of diethylene triamine and dicyandiamide, and alkyl ketene dimer having the formula:

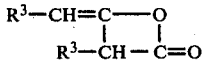

wherein $R^3$ is a hydrocarbon radical, a cycloalkyl radical, an aryl radical, an aralkyl radical, or an alkaryl radical.

14. Cellulosic material treated with sizing treatment compositions according to claim 1, wherein said fluoroaliphatic radical-containing carboxylic acid or salt or hydrolyzable precursor thereof is applied to said cellulosic material in an amount between about 0.03 and 0.3 percent solids on fiber, and said water-soluble epoxidic cationic resin is applied to said cellulosic material in an amount between about 0.1 and 1.5 percent solids on fiber.

15. Cellulosic materials treated with sizing treatment compositions according to claim 11, wherein said fluoroaliphatic radical-containing carboxylic acid or salt or hydrolyzable precursor thereof is applied to said cellulosic material in an amount between about 0.08 and 0.14 percent solids on fiber, said water-soluble epoxidic cationic resin is appled to said cellulosic material in an amount between about 0.4 and 0.8 percent solids on fiber, and said hydrophobic hydrocarbon sizing agent is applied to said cellulosic material in an amount between about 0.05 and 0.1 percent solids on fiber.

16. Shaped articles made from cellulosic materials according to claim 14.

17. Shaped articles made from cellulosic materials according to claim 15.

18. A method for treating cellulosic materials to impart oil and water repellency thereto, comprising the step of applying to said cellulosic materials a treatment composition according to claim 1, wherein said fluoroaliphatic radical-containing carboxylic acid or salt or hydrolyzable precursor thereof is applied to said cellulosic material in an amount between about 0.03 and 0.3 percent solids on fiber, and said water-soluble epoxidic cationic resin is applied to said cellulosic material in an amount between about 0.1 and 1.5 percent solids on fiber.

19. A method for treating cellulosic materials to impart oil and water repellency thereto, comprising the step of applying to said cellulosic materials a treatment composition according to claim 11, wherein said fluoroaliphatic radical-containing carboxylic acid or salt or hydrolyzable precursor thereof is applied to said cellulosic material in an amount between about 0.08 and 0.14 percent solids on fiber, said water-soluble epoxidic cationic resin is applied to said cellulosic material in an amount between about 0.4 and 0.8 percent solids on fiber, and said hydrophobic hydrocarbon sizing agent is applied to said cellulosic material in an amount between about 0.05 and 0.1 percent solids on fiber.

* * * * *

UNITED STATES PATENT AND TRADEMARK OFFICE

CERTIFICATE OF CORRECTION

PATENT NO. : 4,426,466

DATED : 1/17/84

INVENTOR(S) : CRAIG A. SCHWARTZ

It is certified that error appears in the above—identified patent and that said Letters Patent is hereby corrected as shown below:

Column 2, line 66, "$C_8H_{17}SO_2N(C_2H_5)CH_2COONH_4$" should read --$C_8F_{17}SO_2N(C_2H_5)CH_2COONH_4$--.

Column 2, line 67, "$C_8H_{17}SO_2OC_6H_4COOH$" should read --$C_8F_{17}SO_2OC_6H_4COOH$--.

Column 3, line 10, "$C_6H_{13}C_2H_4SO_2C_2H_4COONH_4$" should read --$C_6F_{13}C_2H_4SO_2C_2H_4COONH_4$--.

Column 3, line 13, "$C_8H_{17}SO_2N(C_2H_5)CH_2C_6H_4COOH$" should read --$C_8F_{17}SO_2N(C_2H_5)CH_2C_6H_4COOH$--.

Column 5, line 10, "21≦23" should read --21-23--.

Table IX, line 2 of the heading in the table (under the legend "Example No."), "51" should read --61--.

Column 18, line 26, "appled" should read --applied--.

Signed and Sealed this

*Twelfth* Day of *March 1985*

[SEAL]

*Attest:*

DONALD J. QUIGG

*Attesting Officer* *Acting Commissioner of Patents and Trademarks*